US006655795B2

(12) United States Patent
Wachtel

(10) Patent No.: US 6,655,795 B2
(45) Date of Patent: Dec. 2, 2003

(54) METHOD AND APPARATUS FOR OPTIMIZING INKJET FLUID DROP-ON-DEMAND OF AN INKJET PRINTING HEAD

(75) Inventor: Jonathan Wachtel, Rehovot (IL)

(73) Assignee: Aprion Digital Ltd., Netanya (IL)

( * ) Notice: Subject to any disclaimer, the term of this patent is extended or adjusted under 35 U.S.C. 154(b) by 15 days.

(21) Appl. No.: 10/109,010

(22) Filed: Mar. 29, 2002

(65) Prior Publication Data

US 2003/0184615 A1 Oct. 2, 2003

(51) Int. Cl.[7] ..... B41J 2/17
(52) U.S. Cl. ..... 347/94
(58) Field of Search ..... 347/10, 11, 68–72, 347/94, 46

(56) References Cited

U.S. PATENT DOCUMENTS 4,516,134 A * 5/1985 Tamai et al. ..... 347/75

6,186,610 B1 * 2/2001 Kocher et al. ..... 347/11

* cited by examiner

*Primary Examiner*—Judy Nguyen
*Assistant Examiner*—Michael S Brooke
(74) *Attorney, Agent, or Firm*—Edward Landger, Pat. Atty.; Shiboleth, Yisraeli, Roberts, Zisman & Co.

(57) ABSTRACT

A method for eliminating reflected waves from a vibrating diaphragm surface within an acoustic chamber of an inkjet printer piezo-crystal driver. The first step involves generating an electro-acoustical driven pressure waveform from the piezo-crystal driver, the diaphragm initially acting on ink to release it, wherein the waveform is reflected from a nozzle plate disposed remotely from the diaphragm. Further steps include determining an instant when the reflected pressure waveform returns to the diaphragm surface and producing a matched pulse waveform causing a reverse motion in the diaphragm exactly at that instant, whereby the reverse motion reverses the initial diaphragm action, such that the matched pulse waveform absorbs and eliminates the reflected pressure waveform at the exact instant.

13 Claims, 6 Drawing Sheets

METHOD AND APPARATUS FOR OPTIMIZING INKJET FLUID DROP-ON-DEMAND OF AN INKJET PRINTING HEAD

FIELD OF THE INVENTION

The present invention generally relates to the field of electro-acoustical drivers for inkjet printing heads, and in particular, to a method for eliminating reflecting waves in a piezo crystal inkjet driver to optimize print performance.

BACKGROUND OF THE INVENTION

Piezo crystals are used to drive drop-on-demand, non-thermal, inkjet nozzles. When the electrical pulse that is applied to a piezo crystal has a very short rise-time, the pressure pulse that is generated by a vibrating diaphragm acting on the ink is dominated by its acoustic propagation. A long pulse would compress the ink fluid slowly and acoustic propagation effects would be less significant. Piezo inkjet printing heads may use fast rise-time and high amplitude electrical drive pulses to launch large pressure wave pulses in order to eject fast ink drops. An inkjet structure about 1 millimeter would display an acoustic wave propagation delay of about 1 microsecond. Since 1 microsecond rise-time pulses are commonly used, acoustic delay is usually important.

The total acoustic energy in an ink chamber may be 100 times greater than the energy required to release the ink drop. The excess energy is a source of uncontrolled release of satellite drops, or interference with subsequent drops, or cross talk between nozzles, which could deteriorate printing head performance. Therefore, some mechanism for the dissipation of this acoustic energy is required.

SUMMARY OF THE INVENTION

Accordingly, it is a principal object of the present invention to overcome the disadvantages in the operation of prior art inkjet printer heads, and provide a matched pulse method to optimize inkjet print head performance by eliminating undesirable reflected waves from a piezo crystal driver.

It is another object of the invention to generate matching motions in an electro-acoustical diaphragm to the reflected waves returned from a nozzle surface that will act to neutralize or dampen the returning waves.

It is yet another object of the present invention to improve the rapidity of inkjet printing in the digital printer industry.

It is still another object of the present invention to use long inkjet acoustic channels and wide spacing between inkjet channels to reduce the prior art problems, including cross-talk and heating by the active piezo element.

In accordance with a preferred embodiment of the present invention there is provided a method for eliminating reflected waves from a vibrating diaphragm surface within an acoustic chamber of an inkjet printer piezo-crystal driver. The first step involves generating an electro-acoustical driven pressure waveform from the piezo-crystal driver, the diaphragm initially acting on ink to release it, wherein the waveform is reflected from a nozzle plate disposed remotely from the diaphragm. Further steps include determining an instant when the reflected pressure waveform returns to the diaphragm surface and producing a matched pulse waveform causing a reverse motion in the diaphragm exactly at that instant, whereby the reverse motion reverses the initial diaphragm action, such that the matched pulse waveform absorbs and eliminates the reflected pressure waveform at the exact instant.

Greater distance between the diaphragm, with its piezo driver, and the inkjet nozzle, forces the system to operate in an acoustic mode, where propagation delay and acoustic wave reflections are important. The matched pulse technique allows the use of short pulses and high drop ejection frequencies in a large inkjet chamber. The inkjet head based on the design discussed in this presentation operates as a drop-on demand inkjet head, at frequencies in the range of 100 kHz, but is not limited to that frequency.

Some printing heads are designed with labyrinth channels to dampen excess acoustic energy. A more efficient method is to use a matched pulse that reverses the diaphragm motion exactly at the instant that the reflected pressure wave returns to the diaphragm surface. In a simple one-dimensional structure, a matched pulse would have equal rise and fall rates separated by a time equal to the round trip acoustic delay. In general almost all of the acoustic wave energy that arrives at the nozzle plate is reflected back to its source, the piezo-driven deflection plate. If every increment of return motion of the deflection plate is the reverse of the corresponding increment of transmitting motion occurring earlier, then the reflected wave is entirely absorbed by the deflection plate.

The main advantage of the invention is the generation of a matched pulse to exactly cancel a reflected wave. The pulse features, including rise and fall rates, and pulse duration, are each matched to the reflected wave.

Thus, interference by satellite ink drops is eliminated, and cross-talk between print nozzles is minimized. Extraneous acoustic energy, in general, is dissipated.

Other features and advantages of the invention will become apparent from the following drawings and description.

BRIEF DESCRIPTION OF THE DRAWINGS

For a better understanding of the invention in regard to the embodiments thereof, reference is made to the accompanying drawings and description, in which like numerals designate corresponding elements or sections throughout, and in which:

FIG. 1(*b*) depicts actual ejection from the same inkjet as in FIG. 1(*a*), but by contrast using an unmatched pulse, as is found in the prior art;

DETAILED DESCRIPTION OF THE PREFERRED EMBODIMENTS

The invention will now be described in connection with certain preferred embodiments with reference to the following illustrative figures so that it may be more fully understood. References to like numbers indicate like components in all of the figures.

Figure 1A:
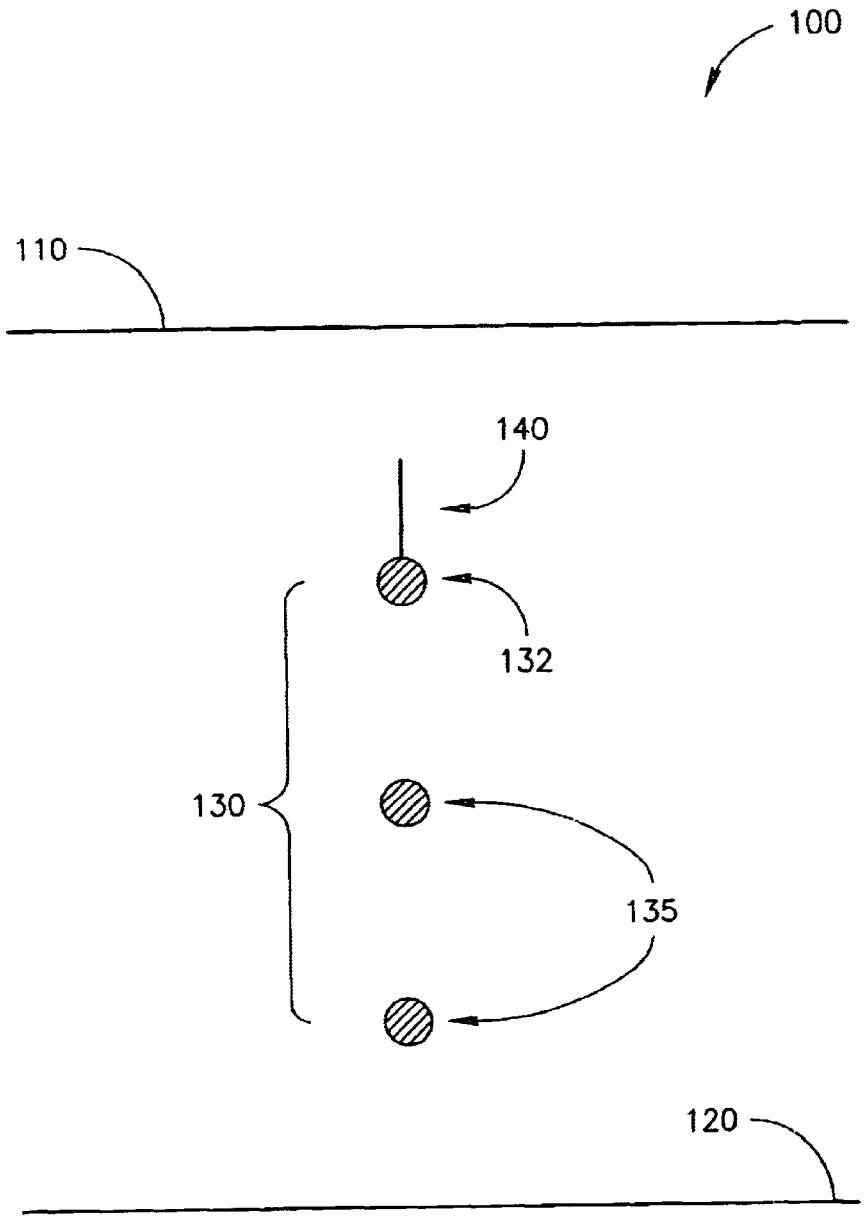
FIG. 1(*a*) depicts actual inkjet ejection using a matched pulse, in accordance with the principles of the present invention.

FIG. 1*a* depicts a schematic illustration of actual inkjet ejection using a matched pulse 100, as is found in stroboscopic photographs, in accordance with the principles of the present invention, for ejection rates of 25 thousand drops per second. Each drop travels from the nozzle plate 110 to the paper 120, a distance of about 1 millimeter (mm). A characteristic of a matched pulse is uniform spacing between the drops 130. A matched drop, in its initial stage of development 132, typically has a tail 140, and due to large surface tension forces, the tail is drawn back into more progressed matched drops 135. Thus, progressed matched drops 135 are correspondingly larger than initial matched drop 132.

Figure 1B:
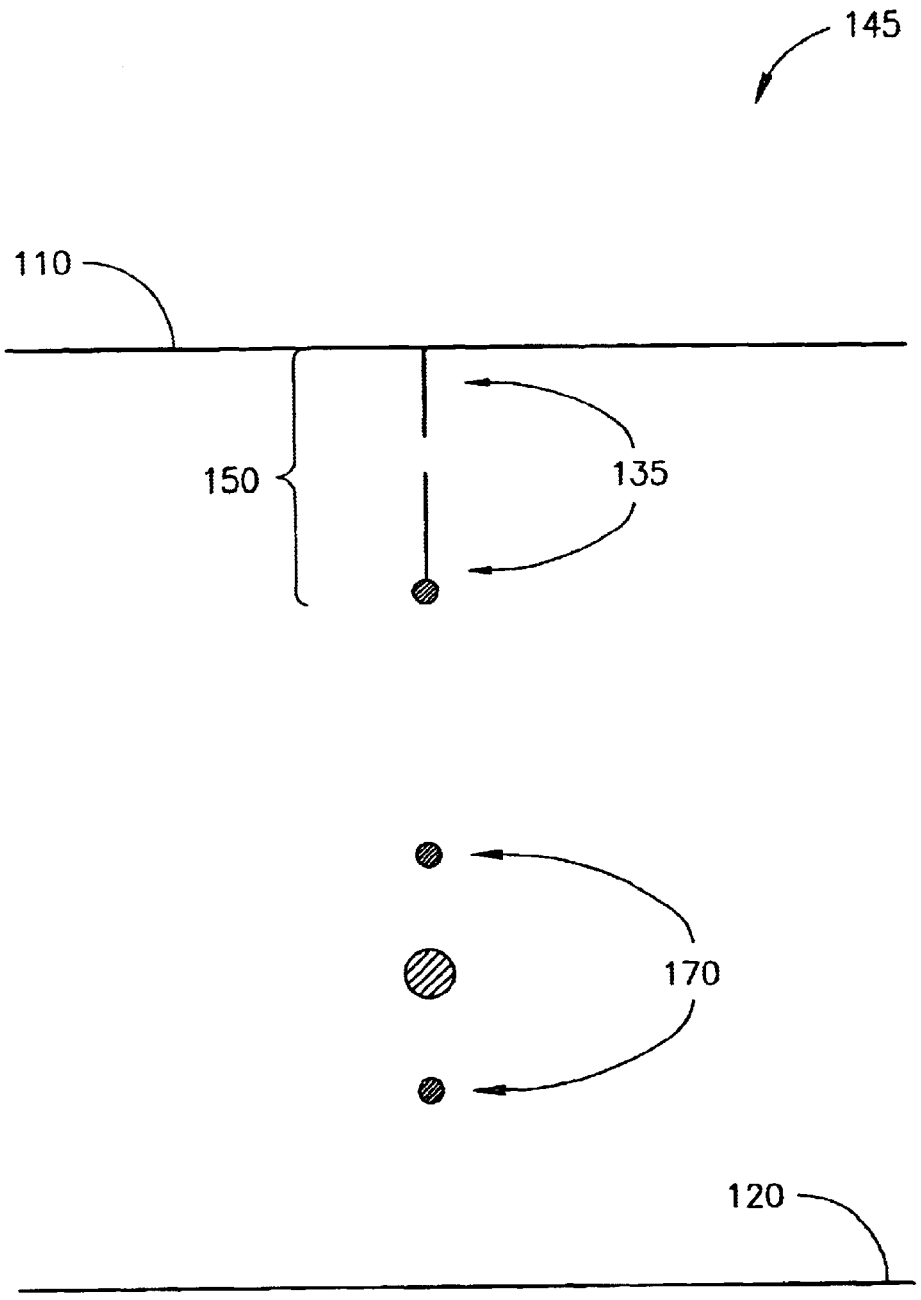
FIG.1B PRIOR ART

FIG. 1*b* depicts actual ejection from the same inkjet as in FIG. 1*a*, but by contrast using an unmatched pulse 145, as is found in the prior art. Of note is the long, segmented trailing tail 150 of unmatched initial drop 160 which, instead of being drawn back into a progressed unmatched drop, each segment 155 is shown to have drawn into separate satellite drops 170.

Figure 2:
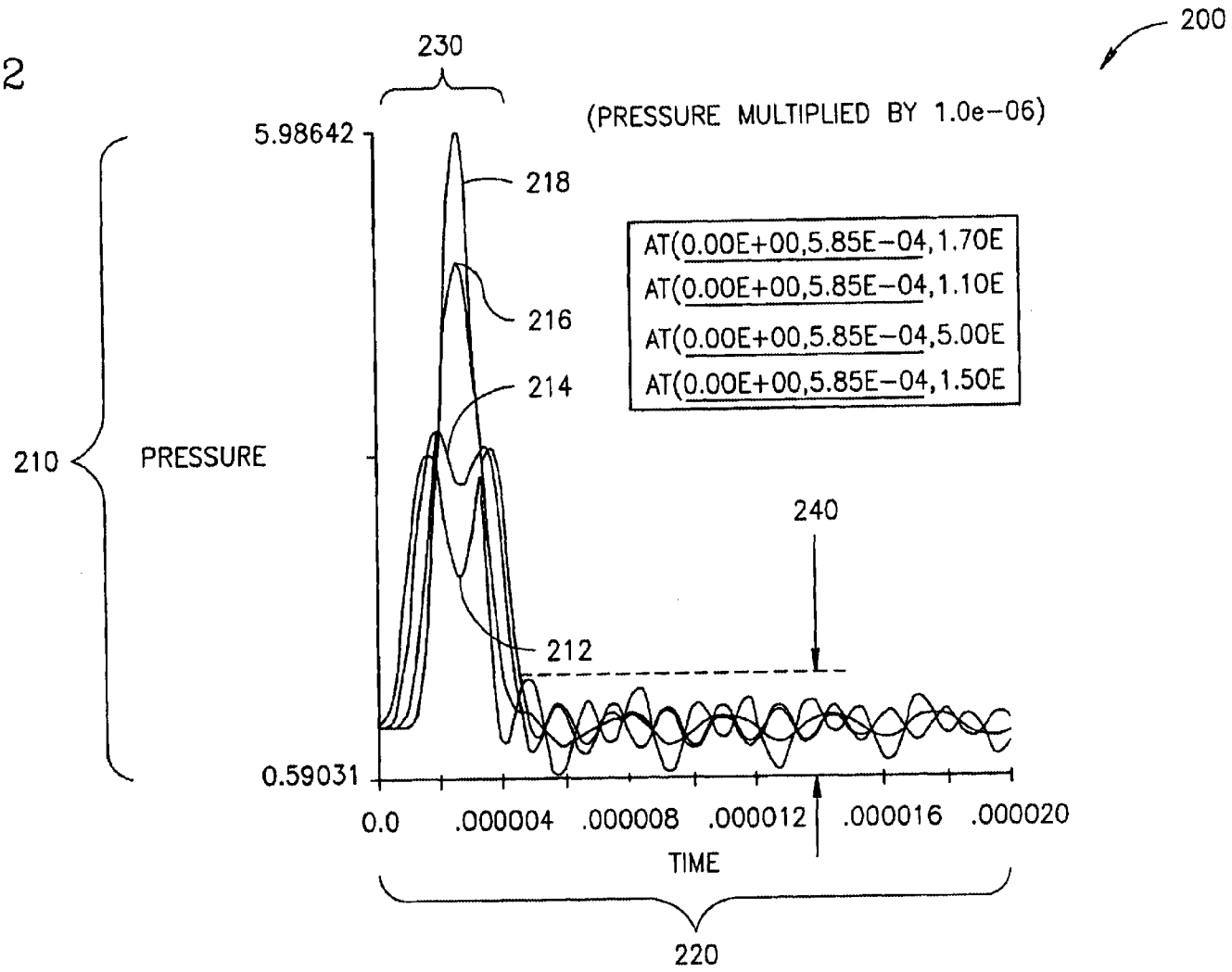
FIG. 2 depicts a graph of the computed pressure wave resulting from a matched pulse waveform, in accordance with the principles of the present invention.

FIG. 2 is a graph depicting the computed pressure wave resulting from the use of a matched pulse waveform 200, in accordance with the principles of the present invention. FIG. 2 has coordinates of pressure 210 vs. time 220, and demonstrates the phenomenon wherein matched pulse excitation exhibits optimum printing head performance. Fluid pressure is given by the function P(x,t), and is measured in dynes per square centimeter at points x=0.15 (212), 0.05 (214), 0.11 (216) and 0.17 (218) cm from the diaphragm. The nozzle plate is located at x =0.1735 cm. A matched pulse requires a delay time equal to 3.3 microseconds for the inkjet structure of the present example.

Figure 3:
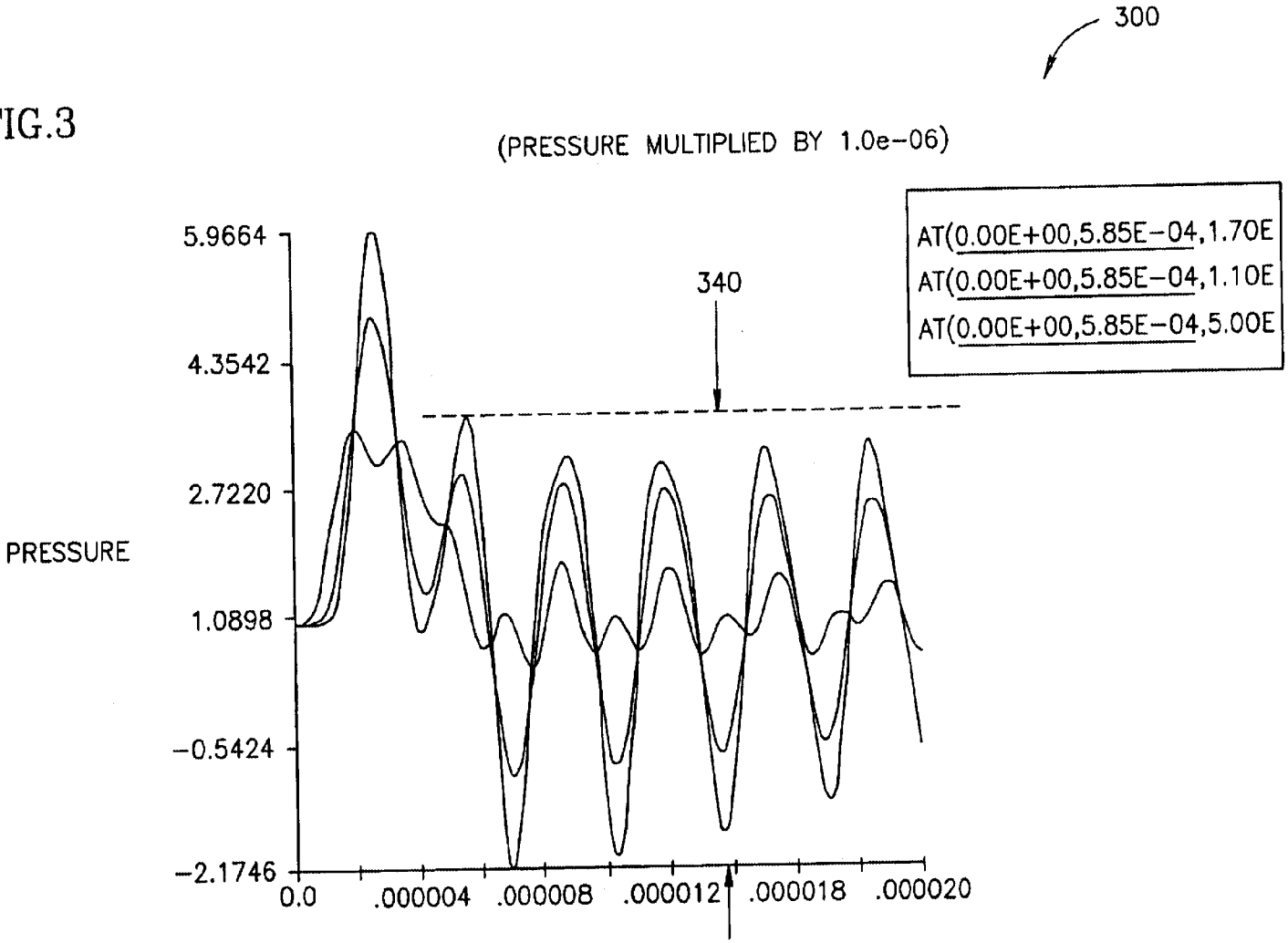
FIG. 3 shows the persistent pressure wave oscillations computed when the 3.3 microseconds of a matched pulse delay is changed to 3.9 microseconds.

Computed simulations for an ideal isolated structure without a nozzle and without ink re-supply path are shown. For a matched pulse satisfying the 3.3 microsecond time delay, the system is quiescent after the first pulse 230. Quiescence is demonstrated by the low variation 240 in pressure for each point in time, and between points. With reference now to FIG. 3, by contrast, there is a relatively high variation 340 in pressure for each point in time, and between points.

The plot in FIG. 3 shows the persistent pressure wave oscillations when the 3.3 microsecond delay is changed to 3.9 microseconds 300. The pulse drive is manifestly mismatched. Computed simulations show the progression of a wave front and the history of the pressure at several points in the acoustic channel. Fluid pressure is given by the function P(x,t), and is measured in dynes per square centimeter at points x=0.05, 0.11 and 0.17 cm from the diaphragm. The nozzle plate is again located at x=0.1735 cm.

Figure 4:
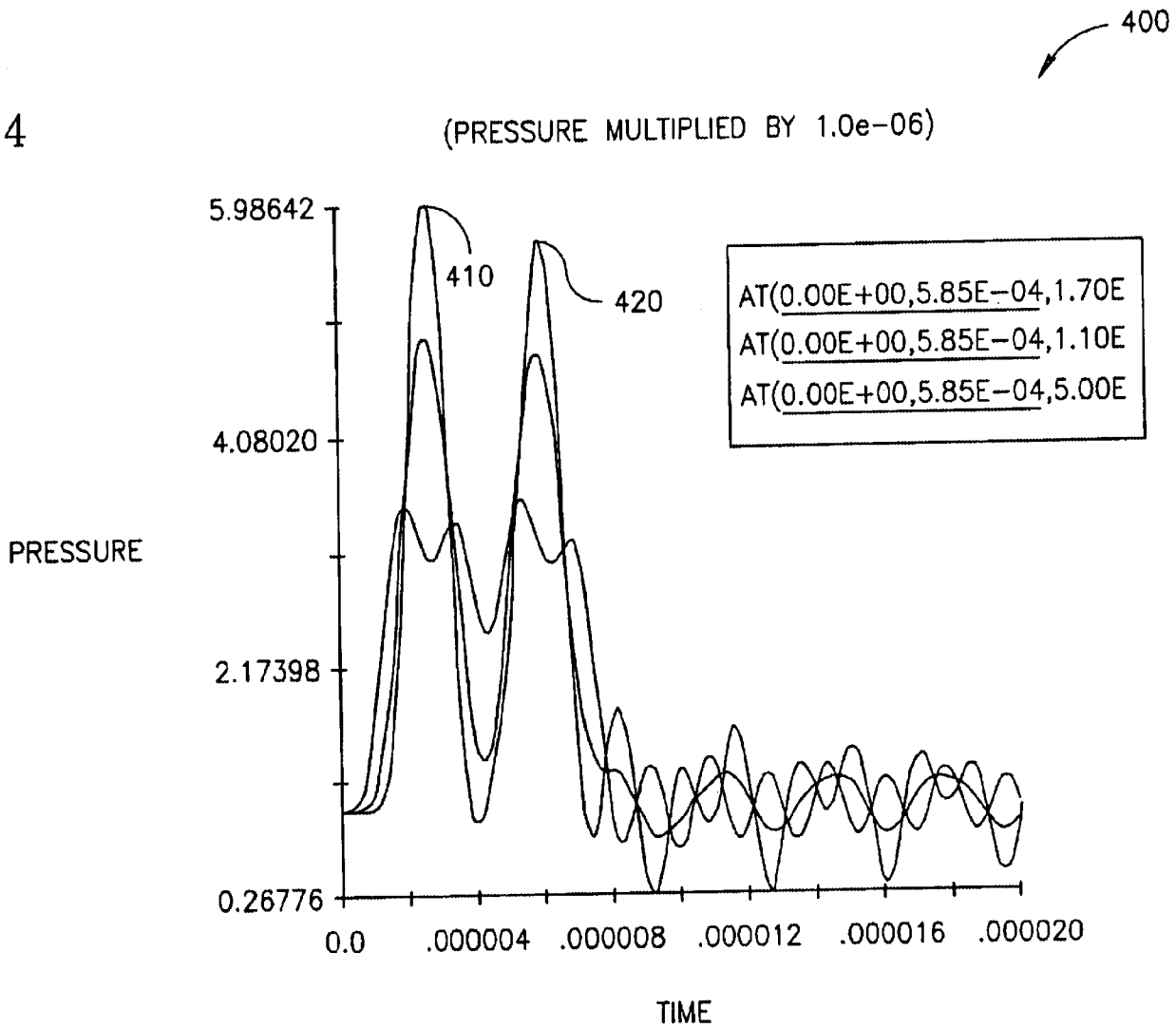
FIG. 4 depicts a graph of the computed pressure wave resulting from superposed/overlapping simple matched pulses, also formed in accordance with the principles of the present invention.

FIG. 4 depicts a graph of the computed pressure wave resulting from superposed/overlapping simple matched pulses 400, also formed in accordance with the principles of the present invention. The computation displayed in FIG. 4 was performed for a complete system using overlapping matched pulses a matched pair of pulses, consisting of a first pulse 410, and a second pulse 420 closely spaced to first pulse 410. Fluid pressure is given by the function P(x,t), and is measured in dynes per square centimeter at points x=0.05, 0.11 and 0.17 cm from the diaphragm. The nozzle plate is located at x=0.1735 cm.

Inclusion of drop ejection and connection to the ink supply system preserves the matching condition. Complicated matched pulses are constructed by superposing (or even overlapping) simple matched pulses, a technique that is valid, due to the linearity of the acoustic wave equations. Bipolar pulses are constructed by combining overlapping positive and negative matched pulses.

Matched pulse acoustics may be simply described using a 1-dimensional system. Consider axial flow of an inviscid fluid in a cylinder. The equations governing the flow are written $$\frac{\partial \rho}{\partial t} + \frac{\partial}{\partial x}(\rho u) = 0 \tag{1}$$

and $$\rho\frac{\partial u}{\partial t} + \rho u\frac{\partial u}{\partial x} = -\frac{\partial P}{\partial x}, \tag{2}$$

where the fluid density $\rho=\rho_0+\rho_1$ is the sum of an equilibrium density and a small perturbation. The equilibrium fluid is at rest so the velocity $\mu=\mu_1$ consists only of its small perturbed part. The pressure P is associated with the perturbation from the equilibrium state. Keeping only linear terms, the fluid equations reduce to $$\frac{\partial \rho_1}{\partial t} + \rho_0\frac{\partial u_1}{\partial x} = 0 \tag{3}$$

and $$\rho_0\frac{\partial u_1}{\partial t} = -\frac{\partial P}{\partial x}. \tag{4}$$

Introducing the compressibility that expresses proportionality of the relative change of the density to the pressure, $$\rho_1=\beta\rho_0 P \tag{5}$$

The time derivative of this equation of state is more useful, $$\frac{\partial \rho_1}{\partial t} = \frac{1}{c^2}\frac{\partial P}{\partial t}. \tag{6}$$

Eliminating the fluid density yields a coupled set in the variables u and P.

$$\frac{1}{c^2}\frac{\partial P}{\partial t} = -\rho_0\frac{\partial u_1}{\partial x} \tag{7}$$

and $$\rho_0\frac{\partial u_1}{\partial t} = -\frac{\partial P}{\partial x}, \tag{8}$$

where $$c^2 = \frac{1}{\beta\rho_0}$$

is recognized as the sound velocity in the fluid.

A further differentiation by x and t yields the familiar wave equations for u and P $$\frac{1}{c^2}\frac{\partial^2 u}{\partial t^2} - \frac{\partial^2 u}{\partial x^2} = 0 \tag{9}$$

and $$\frac{1}{c^2}\frac{\partial^2 P}{\partial t^2} - \frac{\partial^2 P}{\partial x^2} = 0 \tag{10}$$

Arbitrary plane waves of the form $$u=g(x\pm ct) \text{ and } P=f(x\pm ct) \qquad (11)\ (12)$$

satisfy these equations. In the inkjet example the waveform function g is generated by the motion of the fluid at the surface of the diaphragm. Alternatively, the stress in the piezo driver can be considered to cross the diaphragm to generate the waveform function f. The functions f and g are, of course, related by the governing equations.

In the actual inkjet channel the diaphragm is located at one end while the nozzle plate, a reflecting wall with a small central bore containing the nozzle is at the opposite end of the channel. The nozzle is very small and of no concern for the present problem which is to determine constraints on the driving waveform that lead to the elimination of reflected waves appearing at the nozzle plate end wall. Therefore, no generality is lost, and unfolding the channel and placing a second diaphragm at the far end simplify the problem. The unfolded channel is thus twice as long.

The boundary condition at a diaphragm moving with subsonic velocity (much smaller than c) is such that the normal fluid velocity at the point of contact equals the boundary velocity. Therefore, the function g is generated point by point at the transmitting diaphragm, and the waveform propagates without distortion. If the motion of the receiving diaphragm similarly follows the velocity of the incident wave, point by point as it arrives, there will be no reflection. The proof of this statement is that to an observer in the frame of the moving diaphragm, the fluid velocity vanishes at every instant, so there cannot be any reflection. The diaphragm absorbs all the wave energy as work performed by the pressure wave on the moving wall.

The transmitting diaphragm is also the receiving diaphragm in the actual inkjet. The matching condition is that the diaphragm must reverse its motion so that its velocity is equal in magnitude and reversed in sign at a delayed time that is equal to the round trip propagation time of an acoustic pulse. Since the governing equations are linear, any superposition of matched pulses applied to the diaphragm also produces a matched pulse waveform.

A simple mono-polar drive pulse produces a rising pressure wave front that ejects ink and then a falling pressure wave front that terminates the flow. The drop is detached from the fluid remaining in the nozzle. The duration of a simple pulse waveform must be shorter than the time for an acoustic round trip so that the diaphragm is poised to receive the reflected wave front when it arrives. Also, the following pulse should not be applied until the reflected wave energy is absorbed. The length of its acoustic path determines the maximum frequency of a matched pulse inkjet. These constraints may be relaxed for matched pulses constructed by superposition.

Figure 5:
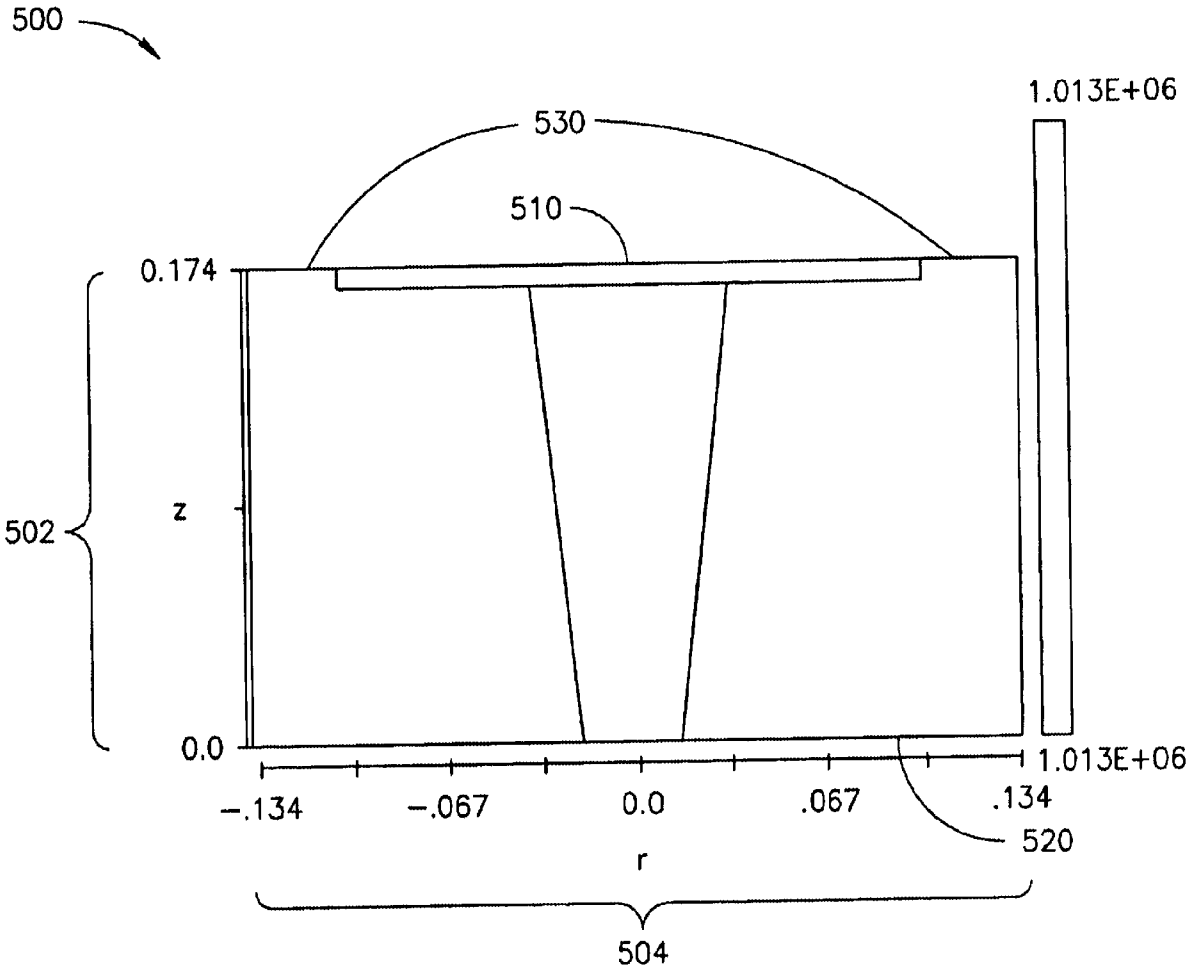
FIG. 5 depicts the acoustic chamber for a piezo-acoustic inkjet, as used in accordance with the principles of the present invention.

FIG. 5 depicts an acoustic chamber 500 for a piezo-acoustic inkjet, in accordance with the principles of the present invention. The coordinates are represented as axial distance 502 vs. radial distance, r 504. The diaphragm contour 510 is at the top and the nozzle plate contour 520 is at the bottom. The nozzle at the center of the nozzle plate is too small for its contour to appear in the diagram. The region 530 surrounding the acoustic chamber contains the ink feed system.

Having described the present invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. A method for eliminating reflected waves from a vibrating diaphragm surface within an acoustic chamber of an inkjet printer piezo-crystal driver, said method comprising:

generating an electro-acoustical driven pressure waveform from the piezo-crystal driver, said diaphragm initially acting on ink to release it, wherein said waveform is reflected from a nozzle plate disposed remotely from said diaphragm;

determining an instant when said reflected pressure waveform returns to said diaphragm surface; and producing a matched pulse waveform causing a reverse motion in said diaphragm exactly at said instant, said reverse motion reversing said initial diaphragm action, such that said matched pulse waveform absorbs and eliminates said reflected pressure waveform at said exact instant.

2. The method as claimed in claim 1, wherein said reverse motion at said diaphragm matches the velocity, and has the same characteristics, as the returning waveform.

3. The method of claim 1, wherein said next following pulse is enabled only after the absorption and elimination of the acoustical energy of a prior pulse.

4. The method of claim 1, wherein the length of the acoustical path of determines the maximum frequency of a matched pulse inkjet using said matched pulse.

5. The method of claim 1, wherein the point-by-point matching rise and fall rates of said matched pulse waveform are separated by a time equal to the round trip acoustical delay of said acoustic wave.

6. The method of claim 1, wherein said matched pulse comprises superimposed matched pressure pulses mitigating constraints on time and duration of a matched pulse and the length of the acoustical path of said matched pulse.

7. The method of claim 1, wherein said inkjet nozzle provides high drop ejection frequencies in an inkjet chamber, sufficiently large so as to produce delayed acoustic reflections.

8. The method of claim 1, wherein said frequencies are in a range greater than about 100 kHz.

9. The method of claim 1, wherein said method utilizes short pulses to generate matched waveforms.

10. The method of claim 1, wherein said method involves utilization of an acoustically long inkjet acoustic channel.

11. The method of claim 1, wherein said method is characterized by the absence of unwanted propagation delay, cross-talk and acoustic wave reflections.

12. An inkjet printer head apparatus, operable to eliminate a reflected pressure waveform, said apparatus comprising:

an acoustic chamber;

a vibrating diaphragm surface of said acoustic chamber;

a piezo-crystal driver;

means for generating an electro-acoustical driven pressure waveform from the piezo-crystal driver, said diaphragm initially acting on ink to release it, wherein said waveform is reflected from a nozzle plate disposed remotely from said diaphragm;

means for determining an instant when said reflected pressure waveform returns to said diaphragm surface; and means for producing a matched pulse waveform causing a reverse motion in said diaphragm exactly at said instant, said reverse motion reversing said initial diaphragm action, such that said matched pulse waveform absorbs and eliminates said reflected pressure waveform at said exact instant.

13. The inkjet printer head apparatus of claim 12, wherein said diaphragm is located at one end, while a nozzle plate comprising a reflecting wall with a small central bore containing the nozzle is at the opposite end.

* * * * *